US011384747B2

(12) United States Patent
Yoshimoto et al.

(10) Patent No.: US 11,384,747 B2
(45) Date of Patent: Jul. 12, 2022

(54) HEAT INSULATING VESSEL FOR LOW TEMPERATURE LIQUEFIED GAS PUMP

(71) Applicant: KAWASAKI JUKOGYO KABUSHIKI KAISHA, Kobe (JP)

(72) Inventors: Daisuke Yoshimoto, Akashi (JP); Shoichiro Hayashi, Kobe (JP); Akira Yamaguchi, Kobe (JP); Koichiro Yamanouchi, Kobe (JP); Yuya Yamane, Kobe (JP); Naoya Kodama, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 624 days.

(21) Appl. No.: 16/338,794

(22) PCT Filed: Nov. 8, 2017

(86) PCT No.: PCT/JP2017/040224
§ 371 (c)(1),
(2) Date: Apr. 2, 2019

(87) PCT Pub. No.: WO2018/092651
PCT Pub. Date: May 24, 2018

(65) Prior Publication Data

US 2020/0040881 A1 Feb. 6, 2020

(30) Foreign Application Priority Data

Nov. 18, 2016 (JP) ..... JP2016-225019

(51) Int. Cl.
*F04B 39/00* (2006.01)
*F04B 15/08* (2006.01)
(Continued)

(52) U.S. Cl.
CPC ..... *F04B 39/00* (2013.01); *F04B 15/08* (2013.01); *F04B 23/023* (2013.01);
(Continued)

(58) Field of Classification Search
None
See application file for complete search history.

(56) References Cited

U.S. PATENT DOCUMENTS 4,418,544 A * 12/1983 Heybutzki ..... F04D 7/02 417/901
4,593,835 A * 6/1986 Kikkawa ..... F04D 7/02 222/131
(Continued)

FOREIGN PATENT DOCUMENTS

CN 103711720 A 4/2014
CN 203671229 U 6/2014
(Continued)

OTHER PUBLICATIONS

Feb. 24, 2021 Office Action issued in Chinese Patent Application No. 201780066992.X.
(Continued)

*Primary Examiner* — Peter J Bertheaud
*Assistant Examiner* — Geoffrey S Lee
(74) *Attorney, Agent, or Firm* — Oliff PLC

(57) ABSTRACT

A heat insulating vessel for a low temperature liquefied gas pump, which includes an inner tank configured to accommodate low temperature liquefied gas, an outer tank provided externally around the inner tank, and a low temperature liquefied gas pump disposed inside the inner tank. The outer tank has an outer tank upper part that is an upper end portion thereof, and an outer tank body other than the outer tank upper part. A lid structure having a heat-insulated structure detachably fitted into an upper part of the inner
(Continued)

tank. The pump is fixed to the lid structure, and a suction pipe and a discharge pipe are insertedly fixed to the lid structure. A vacuum insulating layer is provided between the inner tank and the outer tank. With this heat insulating vessel for the low temperature liquefied gas pump, adiabaticity of the lid structure and maintainability of the pump are increased.

2 Claims, 5 Drawing Sheets

(51) Int. Cl.

| | |
|---|---|
| ***F04B 23/02*** | (2006.01) |
| ***F17C 3/04*** | (2006.01) |
| ***F17C 3/08*** | (2006.01) |
| ***F04D 7/00*** | (2006.01) |
| ***F04D 29/58*** | (2006.01) |
| ***F04D 29/60*** | (2006.01) |
| ***F04B 23/04*** | (2006.01) |
| ***F25D 3/10*** | (2006.01) |

(52) U.S. Cl.

CPC ..... *F04B 23/025* (2013.01); *F04B 23/04* (2013.01); *F04D 7/00* (2013.01); *F04D 29/5893* (2013.01); *F04D 29/606* (2013.01); *F17C 3/04* (2013.01); *F17C 3/08* (2013.01); *F25D 3/10* (2013.01); *F04B 2015/081* (2013.01); *F17C 2203/0341* (2013.01); *F17C 2203/0391* (2013.01); *F17C 2203/0629* (2013.01); *F17C 2227/0135* (2013.01)

(56) References Cited

U.S. PATENT DOCUMENTS

| | | | | |
|---|---|---|---|---|
| 2005/0006392 | A1* | 1/2005 | Yuan | F17C 13/083 220/560.12 |
| 2016/0061384 | A1 | 3/2016 | Caldwell et al. | |

FOREIGN PATENT DOCUMENTS

| | | | |
|---|---|---|---|
| CN | 204877862 | U | 12/2015 |
| CN | 104 564 711 | B | 8/2016 |
| JP | S58-204995 | A | 11/1983 |
| JP | 3434203 | B2 | 8/2003 |
| JP | 2008-261575 | A | 10/2008 |

OTHER PUBLICATIONS

May 4, 2020 Extended Search Report issued in European Patent Application No. 17871666.8.

Feb. 6, 2018 International Search Report issued in International Application No. PCT/JP2017/040224.

* cited by examiner

HEAT INSULATING VESSEL FOR LOW TEMPERATURE LIQUEFIED GAS PUMP

TECHNICAL FIELD

The present disclosure relates to a heat insulating vessel for low temperature liquefied gas pump, and particularly to the heat insulating vessel with an increased maintainability of the pump and a vacuum insulating layer.

BACKGROUND ART

Various low temperature liquefied gas pumps which pump super-low temperature liquefied gases, such as a liquefied helium, liquefied hydrogen, liquefied nitrogen, liquefied oxygen, liquefied argon, and LNG, have been put in practical use. For example, as the low temperature liquefied gas pumps, an in-tank pump which is installed in an immersed state in low temperature liquefied gas inside a liquefied gas tank which stores low temperature liquefied gas (submerged pump), and a pod-type pump which is provided outside the liquefied gas tank and is installed inside a heat insulating vessel connected to the liquefied gas tank are known.

When performing the maintenance of the in-tank pump, since the pump must be taken out from the tank after the low temperature liquefied gas is discharged from the low temperature liquefied gas tank and the liquefied gas inside the tank is replaced by inactive gas, this pump is inferior in the maintainability. Although a pump may be installed outside the tank in a normal temperature state, it is required to be pre-cooled before the pump is actuated. Therefore, there is a demerit that boil-off gas is also generated due to the pre-cooling.

Patent Document 1 discloses a heat insulating vessel for low temperature liquefied gas pump which is provided to a tanker or tank lorry which conveys low temperature liquefied gas and accommodates a pod-type pump. This heat insulating vessel accommodates the low temperature liquefied gas pump in the low temperature liquefied gas in an immersed state.

The heat insulating vessel for the low temperature liquefied gas pump has a casing and a lid. The casing includes a cylindrical inner wall (inner tank) with a bottom, an outer wall (outer tank) externally covering the inner wall so as to have a vacuum insulating layer therebetween, and a ceiling wall airtightly covering an upper opening of the inner wall and the outer wall. The heat insulating vessel is provided with a stationary plate to which a lower end of the outer wall is fixed, and a plurality of vertical plates for attachment which couples the lid described above piled up on the ceiling wall to the stationary plate, and a sealed pump is accommodated in the inner wall. A suction port and a return port which returns vaporized gas are connected to the outer wall, and a discharge pipe connected to the sealed pump penetrates the ceiling wall and the lid and extends to the outside. Note that the suction port and the return port are to penetrate the outer wall and to be connected to the inner wall.

REFERENCE DOCUMENT OF PRIOR ART

Patent Document

Patent Document 1: JP3434203B2

DESCRIPTION OF THE DISCLOSURE

Problems to be Solved by the Disclosure

Since the heat insulating vessel for the low temperature liquefied gas pump of Patent Document 1 has the structure in which the ceiling wall contacts the lid without a heat insulating layer, heat input from the ceiling wall and the lid is large. In the heat insulating vessel of Patent Document 1, for the maintenance, the pump cannot be taken out and the heat insulating layer cannot be exposed outside.

However, for the maintenance, a practical heat insulating vessel for the low temperature liquefied gas pump requires a pump extracting structure in which the low temperature liquefied gas pump can easily be extracted to the outside, and a structure in which the vacuum insulating layer can easily be exposed outside.

Since a suction pipe, a discharge pipe, a gas pipe, and a plurality of pressure detecting pipes which detect a filling state of the low temperature liquefied gas in the inner tank, electric wires for driving the pump system, signal wires for a vibration sensor and a temperature sensor, etc. are attached to the heat insulating vessel, it is not easy to provide the pump extracting structure and the heat insulating layer exposing structure.

One purpose of the present disclosure is to provide a heat insulating vessel for a low temperature liquefied gas pump which increases adiabaticity of a lid structure and increases maintainability of a pump.

SUMMARY OF THE DISCLOSURE

A heat insulating vessel for a low temperature liquefied gas pump according to one aspect of the present disclosure includes an inner tank configured to accommodate low temperature liquefied gas, an outer tank provided externally around the inner tank, and a low temperature liquefied gas pump disposed inside the inner tank. The outer tank has an outer tank upper part that is an upper end side portion thereof, and an outer tank main body other than the outer tank upper part. A lid structure having a heat-insulated structure detachably fitted into an upper part of the inner tank is provided. The pump is fixed to the lid structure, and a suction pipe and a discharge pipe are insertedly fixed to the lid structure. A vacuum insulating layer is formed between the inner tank and the outer tank.

According to the structure, insulation efficiency of the heat-insulating vessel on the lid side can improve with the lid structure having the heat-insulated structure. Further, by removing the lid structure upward, the pump can easily be removed together with the suction pipe and the discharge pipe from the inner tank, thereby the maintenance of the vacuum insulating layer becomes easy.

A vacuum-pump port may be formed in the outer tank upper part.

According to the structure, the outer tank main body can be removed without affecting signal wires introduced from the vacuum-pump port to the vacuum insulating layer, etc.

One of a pressure detecting pipe and a drain pipe penetratedly fixed to the outer tank upper part may be provided. According to the structure, the outer tank main body can be removed without affecting the pressure detecting pipe and the drain pipe.

The pump may be fixed to the lid structure through a pump supporting mechanism. According to the structure, the pump can easily be removed with the lid structure and the pump supporting mechanism.

The pump supporting mechanism may include a plurality of first guide members fixed to an inner surface of the inner tank and each having a vertical first guide groove, a plurality of first bar-like members slidably attached to the first guide grooves of the plurality of first guide members, upper ends of the first bar-like members being coupled to the lid structure, and a plurality of coupling members coupling the pump to the plurality of first bar-like members.

According to the structure, the pump supporting mechanism with a simple structure can be achieved.

A position regulating mechanism configured to regulate the position of the inner tank may be provided so that the inner tank does not move in a direction perpendicular to the axis of the inner tank with respect to the outer tank. The position regulating mechanism may include a plurality of second guide members fixed to one of an inner surface of the outer tank and an outer surface of the inner tank, and each having a vertical second guide groove, and a plurality of engagement coupling members each fixed to one of the outer surface of the inner tank and the inner surface of the outer tank, and each having an engaging part slidably engaged with the second guide groove of each of the plurality of second guide members.

According to the structure, the positional regulation can be performed so that the inner tank does not move in the direction perpendicular to the axis with respect to the outer tank and the position regulating mechanism having a simple structure can be achieved.

The vacuum insulating layer may be filled up with one of laminated heat insulating material and pearlite. According to the structure, the vacuum insulating layer with excellent insulation efficiency can be obtained.

A synthetic resin foamed body may be provided inside the lid structure. According to the structure, the insulation efficiency of the lid structure can be secured.

Laminated heat insulating material may be provided in a heat insulation gap inside the lid structure, and a vacuum layer is formed inside the lid structure. According to the structure, the insulation efficiency of the lid structure can be secured.

MODES FOR CARRYING OUT THE DISCLOSURE

The modes for carrying out the present disclosure will be described based on embodiments.

Embodiment 1

Figure 1:
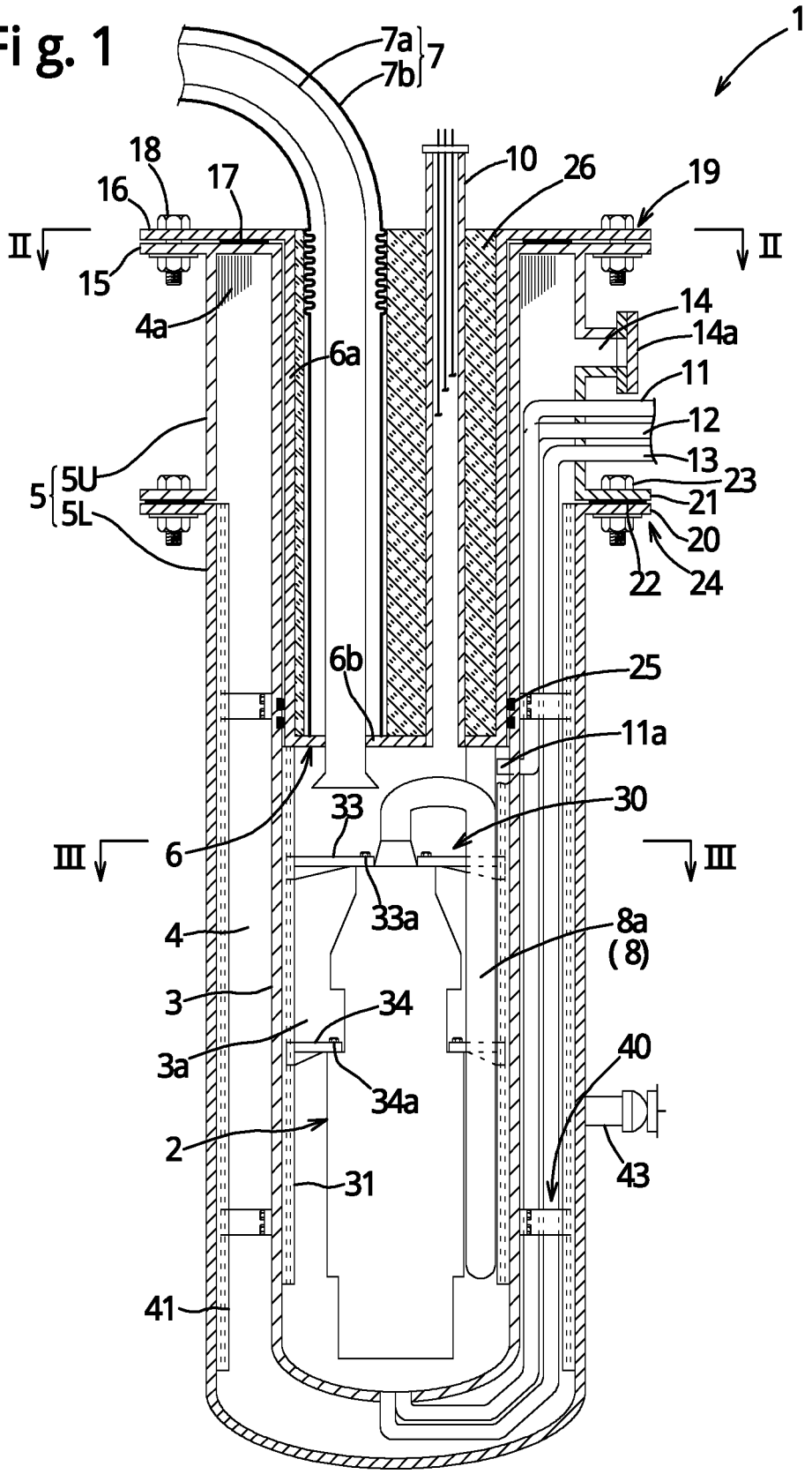
FIG. 1 is a cross-sectional view of a heat insulating vessel for a low temperature liquefied gas pump of Embodiment 1 of the present disclosure.
Figure 2:
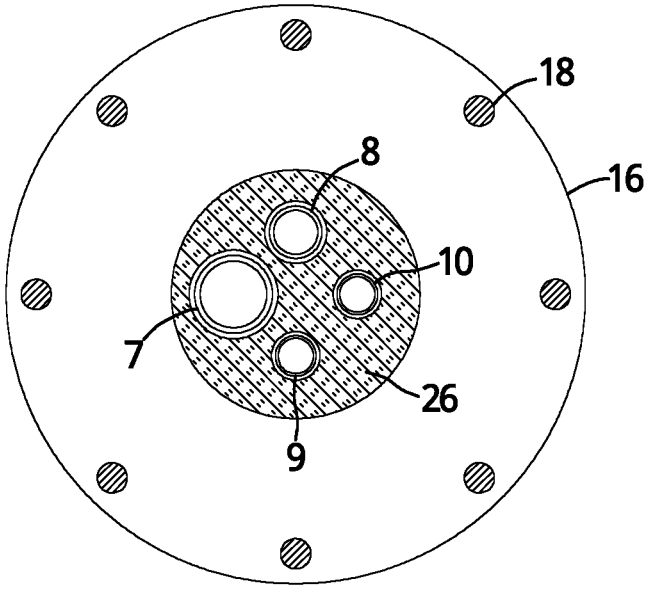
FIG. 2 is a cross-sectional view taken along a line II-II of FIG. 1.

As illustrated in FIGS. 1 and 2, a heat insulating vessel 1 for a low temperature liquefied gas pump is a heat insulating vessel which accommodates a low temperature liquefied gas pump which pumps low temperature liquefied gas, such as liquefied helium, liquefied hydrogen, liquefied nitrogen, liquefied oxygen, liquid air, or LNG The low temperature liquefied gas of this embodiment is liquefied hydrogen, and a low temperature liquefied gas pump 2 is to pressurize the liquefied hydrogen supplied through a double pipe having a heat-insulated structure from a liquefied hydrogen storage tank, and pump it to the double pipe having the heat-insulated structure disposed outside. For example, the low temperature liquefied gas pump 2 is applicable to an application in which it pumps the liquefied hydrogen to a refrigerant passage between an inner pipe and an outer pipe of the double pipe having the heat-insulated structure for the liquefied hydrogen pump.

This heat insulating vessel 1 for the low temperature liquefied gas pump (hereinafter, referred to as "the heat insulating vessel") includes an inner tank 3 having a vertical axis which accommodates the liquefied hydrogen, an outer tank 5 provided externally over a perimeter of the inner tank 3 so as to be spaced from the inner tank 3 to form a vacuum insulating layer 4, the low temperature liquefied gas pump 2 installed inside the inner tank 3, a lid structure 6, and a suction pipe 7 which sucks the liquefied hydrogen, a discharge pipe 8 which discharges the pressurized liquefied hydrogen, a gas pipe 9 which delivers the hydrogen gas vaporized from the inner tank 3, an electric wire pipe 10 through which electric wires pass, two pressure detecting pipes 11 and 12, and a drain pipe 13.

The heat insulating vessel 1, and various members accompanying the vessel which constitute various accessory structures (described later) are made of steel for low temperature (in this embodiment, stainless steel), and members made of materials other than the steel for low temperature will be particularly described with the names of materials.

The inner tank 3 is a container which is constructed so as to be capable of accommodating the liquefied hydrogen by closing with a bowl-like end plate the bottom of an elongated narrow cylindrical body having a given diameter. The outer tank 5 is constructed by closing with a bowl-like end plate the bottom of an elongated narrow cylindrical body having a diameter larger than the inner tank 3. The outer tank 5 covers externally around the inner tank 3 (an outer circumferential surface and a bottom surface) so that it is separated from the inner tank 3 to form the vacuum insulating layer 4. In this embodiment, the vacuum insulating layer 4 accommodates a known laminated heat insulating material 4*a* (super insulation, SI) and is made into a vacuum state. Note that a vacuum insulating layer which is filled up with pearlite instead of the laminated heat insulating material 4*a* and is made into the vacuum state may also be employed. Note that, in this case, the thickness in the radial direction of the vacuum insulating layer 4 may be set as a required dimension.

The outer tank 5 has a cylindrical outer tank upper part 5U which constitutes an upper-end side portion and an outer tank main body 5L other than the outer tank upper part 5U. A vacuum-pump port 14 which is connectable with an external vacuum pump is formed in the outer tank upper part 5U, and it is openably closed by a lid member 14*a*. Signal wires for a vacuum indicator or a temperature sensor are introduced into the vacuum-pump port 14.

A first annular flange 15 projected radially outward is provided to upper ends of the inner tank 3 and the outer tank upper part 5U. A second annular flange 16 having the same outer diameter as the first flange 15 is provided to a perimeter part of an upper end of the lid structure 6. A first fastening part 19 is provided, which fastens the second flange 16 to the first flange 15 with a plurality of bolts 18 in a state where a sheet-like gasket 17 for a low temperature intervenes between the first and second flanges 15 and 16.

A third annular flange 20 projected radially outward is provided to an upper end of the outer tank main body 5L. A fourth annular flange 21 having the same outer diameter as the third flange 20 is provided to a lower end of the outer tank upper part 5U. A second fastening part 24 is provided, which fastens the fourth flange 21 to the third flange 20 with a plurality of bolts 23 in a state where a sheet-like gasket 22 for a low temperature intervenes between the third and fourth flanges 20 and 21.

The lid structure 6 has a heat-insulated structure which is detachably fitted into an upper part of the inner tank 3 by a given length. The lid structure 6 is formed by integrally joining a cylindrical body 6*a* fitted into the inner tank 3 with a slight gap so as to be slidable in the vertical direction, a bottom plate 6*b* which closes the bottom of the cylindrical body 6*a*, and the second flange 16. At positions corresponding to parts close to a lower end of the cylindrical body 6*a*, O-rings 25 for low temperature are attached to a plurality of annular seal grooves formed in the inner tank 3 so that the O-rings 25 fluid-tightly seals between the inner tank 3 and the lid structure 6.

An accommodation chamber 3*a* is formed in a space inside the inner tank 3 below the lid structure 6, which accommodates the liquefied hydrogen and the low temperature liquefied gas pump 2. The suction pipe 7 and the discharge pipe 8 each comprised of the vacuum insulating double pipe, the gas pipe 9, and the electric wire pipe 10 are inserted into the cylindrical body 6*a* of the lid structure 6, and the pipes 7-10 are installed in a vertical posture parallel to the axis of the inner tank 3. A lower end portion of an inner pipe 7*a* of the suction pipe 7 penetrates the bottom plate 6*b* and is inserted into the accommodation chamber 3*a*, a lower end thereof is opened inside the accommodation chamber 3*a*, and a lower end of an outer pipe 7*b* is joined to an upper surface of the bottom plate 6*b*.

The discharge pipe 8 is comprised of the vacuum insulating double pipe comprised of an inner pipe and an outer pipe, the inner pipe has a U-shaped pipe 8*a* which penetrates the bottom plate 6*b*, extends to a location near the bottom part of the accommodation chamber 3*a*, and then makes a U-turn upwardly. An upper end part of the U-shaped pipe 8*a* is curved and connected to a discharge port located at a top part of the pump 2. A lower end of the gas pipe 9 is joined to an upper surface of the bottom plate 6*b*. A lower end part of the electric wire pipe 10 is joined to the bottom plate 6*b*, and electric power cables for driving the pump which are connected to the pump 2, signal wires for the vibration sensor and the temperature sensor attached to the pump 2 are inserted in the electric wire pipe 10.

A space (i.e. heat insulation gap) outside the pipes 7-10 among the space inside the cylindrical body 6*a* of the lid structure 6 is filled up with a heat insulator 26 made of urethane foamed body (PUF). Note that a top plate which closes the top surface of the lid structure 6 is provided, and instead of the urethane foamed body 26, the space may be filled up with pearlite to be made into a vacuum state, or may be filled up with a laminated heat insulating material to be made in a vacuum state. The low temperature liquefied gas pump 2 is a centrifugal pump made of metal for low temperature, such as stainless steel, is installed in the accommodation chamber 3*a* so that its axis is oriented vertically. This pump 2 is fixed to the lid structure 6 through a pump supporting mechanism 30 described later.

Figure 3:
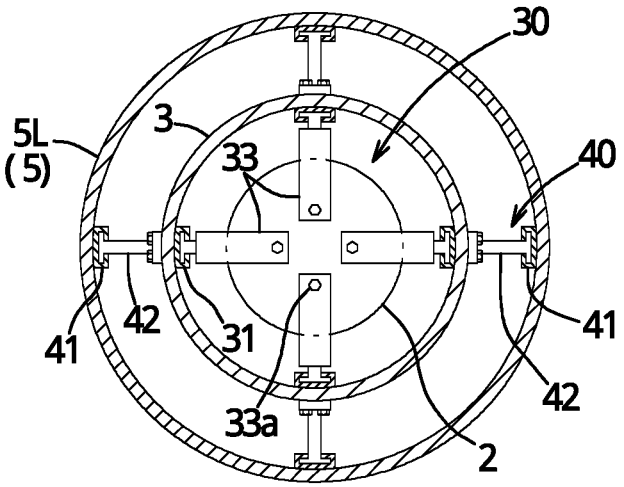
FIG. 3 is a cross-sectional view taken along a line III-III of FIG. 1.
Figure 4:
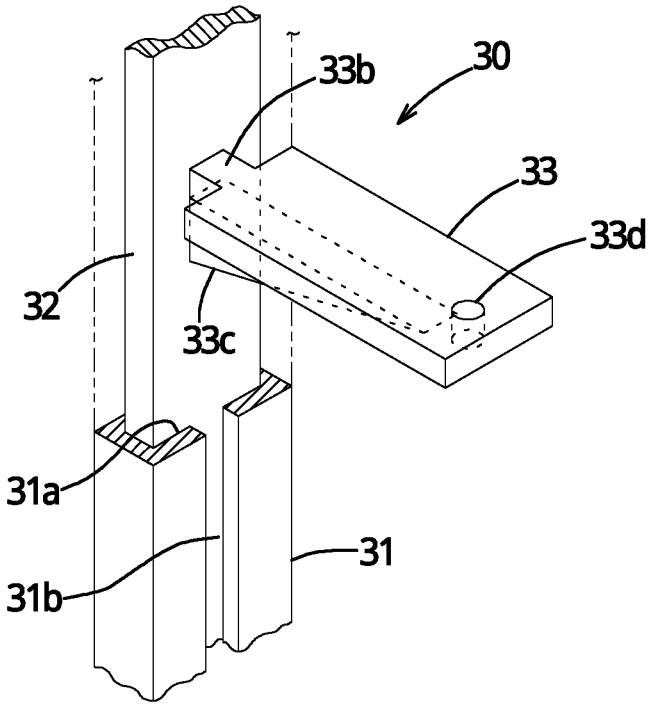
FIG. 4 is a perspective view illustrating a substantial part of a pump supporting mechanism.

As illustrated in FIGS. 1, 3, and 4, the pump supporting mechanism 30 includes a plurality of (in this embodiment, four) first guide members 31 each fixed to an inner surface of the inner tank 3 inside the accommodation chamber 3*a* and each having a vertical first guide groove 31*a*, a plurality of (in this embodiment, four) first bar-like members 32 slidably attached to the first guide grooves 31*a* of the plurality of first guide members 31, respectively, and coupled at an upper end part to the bottom plate 6*b* of the lid structure 6, pluralities of (in this embodiment, four each) first and second coupling members 33 and 34 which couple the pump 2 to the plurality of first bar-like members 32. The first coupling members 33 are to couple a top part of the pump 2 to the first bar-like members 32, and the second coupling members 34 are to couple a middle part of the pump 2 to the first bar-like members 32.

The first guide member 31 is a section bar having a rectangular cross section and slightly shorter than a vertical length of the accommodation chamber 3*a*, and the first guide groove 31*a* of a short T-shaped groove is formed over the entire length of the section bar. The four first guide members 31 are installed in a vertical posture at four equally divided positions in the circumferential direction on the inner surface of the inner tank 3 so that the first guide grooves 31*a* face radially inward, and are joined to the inner surface of the inner tank 3.

The first bar-like member 32 of a flat bar shape is attached to each of the four first guide members 31 so as to be slidable in the vertical direction. The four first coupling members 33 fixed to the four first bar-like members 32, respectively, are fastened to the top part of the pump 2 with bolts 33*a*.

The first coupling member 33 is fixed perpendicular to the first bar-like members 32 and extends from the first bar-like members 32 toward the pump 2, a base-end part of the first coupling member 33 is coupled to the first bar-like member 32 with bolts. A neck part 33*b* which can pass through an opening groove portion 31*b* of the first guide groove 31*a* is formed in the base-end part of the first coupling member 33. Moreover, a reinforcement bracket 33*c* which can pass through the opening groove portion 31*b* is formed in a lower surface side of the first coupling member 33.

A bolt hole 33*d* is formed in a tip end part of the first coupling member 33, and the pump 2 is coupled to the first bar-like members 32 by bringing the tip end parts in contact with the top part of the pump 2 and fastening the bolts 33*a* each inserted in the bolt hole 33*d* to a bolt hole of a case of the pump 2.

Although the second coupling member 34 is shorter than the first coupling member 33, it is similar to the first coupling member 33. The second coupling member 34 is coupled to the first bar-like member 32 similar to the first coupling member 33, and a tip end part thereof is fastened to the middle part of the case of the pump 2 with a bolt 34*a*.

With the above structure, since the first bar-like members 32 are slidable in the vertical direction with respect to the first guide members 31, the four first bar-like members 32 and the pump 2 which are coupled to and supported by the lid structure 6 can be drawn out upwardly by drawing out the lid structure 6 and the pipes 7-10 upwardly upon the maintenance of the pump 2.

Figure 5:
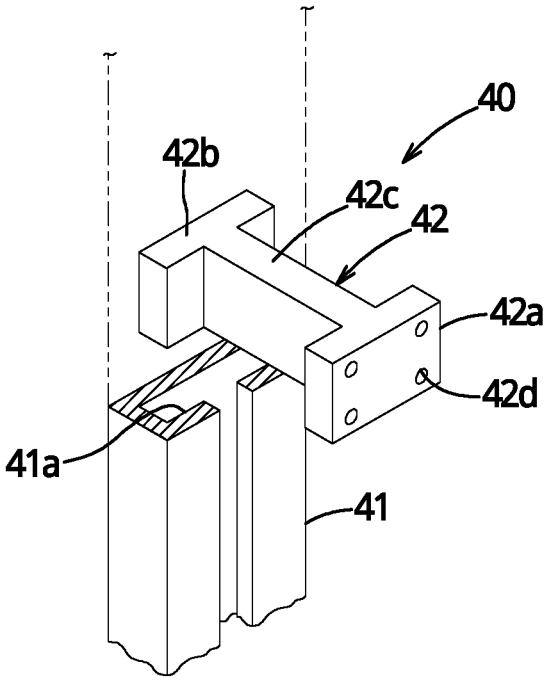
FIG. 5 is a perspective view illustrating a substantial part of a position regulating mechanism.

As illustrated in FIGS. 1, 3, and 5, a position regulating mechanism 40 is provided, which positionally regulates the inner tank 3 so that the inner tank 3 does not move in a direction perpendicular to the axis with respect to the outer tank 5. The position regulating mechanism 40 includes a plurality of (in this embodiment, four) second guide members 41 each fixed to an inner surface of the outer tank body 5L and each having a vertical second guide groove 41*a*, and a plurality of (in this embodiment, eight) engagement coupling members 42 each fixed to an outer surface of the inner tank 3, and each having an engaging part 42*b* slidably engaged with the second guide groove 41*a* of each of the plurality of second guide members 41. Note that at least one of the second guide member 41 and the engagement coupling member 42 may be made of fiber-reinforced synthetic resin (for example, GFRP, CFRP, etc.).

The four upper engagement coupling members 42 are provided at a position slightly above a middle of the inner tank 3, and the four lower engagement coupling members 42 are provided at a position close to a lower end of the inner tank 3.

The second guide member 41 is a section bar having a rectangular cross section and slightly shorter than a vertical length of the outer tank body 5L, and the second guide groove 41*a* of a short T-shaped groove is formed over the entire length of the section bar. The four second guide members 41 are installed in a vertical posture at four equally divided positions in the circumferential direction on the inner surface of the outer tank body 5L so that the second guide grooves 41*a* face radially inward, and are joined to the inner surface of the outer tank body 5L.

The engagement coupling member 42 is a member having an I-shaped cross section with a given vertical width. The engagement coupling member 42 includes a fixed flange 42*a* fastened to the outer surface of the inner tank 3 with four bolts passing through four bolt holes 42*d*, an engagement flange 42*b* (engaging part) attached to the second guide groove 41*a* of the second guide member 41 so as to be slidable in the vertical direction, and a web 42*c* which integrally connects the fixed flange 42*a* to the engagement flange 42*b*.

With the above structure, a relative movement of the outer tank 5 and the inner tank 3 is possible only in the vertical direction through the four upper engagement coupling members 42 and the four lower engagement coupling members 42, and a relative movement of the inner tank 3 in a direction perpendicular to the axis is prohibited. Therefore, upon the maintenance of the vacuum insulating layer 4, the outer tank body 5L is possible to be drawn out downwardly by separating the second fastening part 24, without affecting the vacuum insulating layer 4.

Note that, as an alternative of the above structure, the four engagement coupling members 42 may be fixed to the inner surface of the outer tank body 5L and the second guide member 41 may be fixed to the outer surface of the inner tank 3.

Next, the pressure detecting pipes 11 and 12, the drain pipe 13, and a rupture disk 43, etc. will be described. The first pressure detecting pipe 11 which detects the pressure of the top part of the accommodation chamber 3*a* filled up with the liquefied hydrogen, the second pressure detecting pipe 12 which detects the pressure of the bottom part of the accommodation chamber 3*a*, and the drain pipe 13 which discharges drain from the bottom part of the accommodation chamber 3*a* are formed. The first and second pressure detecting pipes 11 and 12 and the drain pipe 13 penetrate and are fixed to the outer tank upper part 5U.

The first pressure detecting pipe 11 extends downwardly inside the vacuum insulating layer 4 from the penetrated part which penetrates the outer tank upper part 5U, and penetrates the inner tank 3 at the part corresponding to the top part of the accommodation chamber 3*a*. A tip end 11*a* of the first pressure detecting pipe 11 projects slightly from the inner surface of the inner tank 3, and is opened. The second pressure detecting pipe 12 extends downwardly inside the vacuum insulating layer 4 from the penetrated part which penetrates the outer tank upper part 5U, then extends to outside of the central part of the bottom of the inner tank 3, and penetrates the central part of the bottom of the inner tank 3. A tip end of the second pressure detecting pipe 12 is opened inside the bottom of the inner tank 3.

The drain pipe 13 extends downwardly inside the vacuum insulating layer 4 from the penetrated part which penetrates the outer tank upper part 5U, then extends to outside of the central part of the bottom of the inner tank 3, and penetrates the central part of the bottom of the inner tank 3. A tip end of the drain pipe 13 is opened inside the bottom of the inner tank 3.

The rupture disk 43 is provided to a given part in a lower part of the outer tank main body 5L, which relieves the pressure when the pressure of the vacuum insulating layer 4 abnormally increases. Note that the heat insulating vessel 1 is installed in a state where it is supported by a support base (not illustrated) made of normal steel installed on base concrete.

Next operation and effects of the heat insulating vessel 1 for the low temperature liquefied gas pump will be described. Normally, the liquefied hydrogen in the liquefied hydrogen storage tank is filled up by the head pressure into the accommodation chamber 3*a* via the suction pipe 7. The filled-up liquefied hydrogen is pressurized by the pump 2, and is discharged outside from the discharge pipe 8. The boil-off gas generated in the accommodation chamber 3*a* is drawn outside through the gas pipe 9.

Since the vacuum insulating layer 4 between the inner tank 3 and the outer tank 5 is filled up with the laminated heat insulating material 4*a* (or pearlite) and is held at the vacuum state, and the lid structure 6 is insulated with the urethane foamed body 26 with large thickness, the heat insulating vessel 1 is a highly heat-insulated container. In addition, since the vertical length of the lid structure 6 is long, the heat transfer distance of the pipes 7-10 can be made long to lessen the heat input from the pipes 7-10. Since the urethane foamed body 26 is disposed in the lid structure 6 at a location above the bottom plate 6*b*, the liquefied hydrogen inside the accommodation chamber 3*a* will not be polluted with the urethane foamed body 26.

Upon the maintenance of the pump 2, when the fastening of the first fastening part 19 is released, and the lid structure 6 and the pipes 7-10 are extracted upwardly, the first bar-like members 32 of the pump supporting mechanism 30 slide upwardly with respect to the first guide members 31, and the pump 2 supported by the first bar-like members 32 is also moved upwardly. Thus, the pump 2 can be extracted upwardly. Thus, since the pump 2 can be extracted easily without breaking the vacuum of the vacuum insulating layer 4, the maintenance can easily be performed.

After the maintenance of the pump 2 is finished, the first bar-like members 32 and the pump 2 are inserted into the inner tank 3, the first bar-like members 32 are inserted into the first guide grooves 31*a* of the first guide members 31, the second flange 16 is brought into contact with the first flange 15 and the gasket 17 for the low temperature, and the first fastening part 19 is fastened.

When performing the maintenance of the laminated heat insulating material 4*a* etc. of the vacuum insulating layer 4 between the inner tank 3 and the outer tank 5, the fastening of the second fastening part 24 is released, and the outer tank main body 5L is drawn out downwardly, or heat insulating vessel portions of the heat insulating vessel 1 other than the outer tank main body 5L is drawn out upwardly, thereby exposing most part of the vacuum insulating layer 4 externally.

At this time, since the engagement flanges 42*b* of the engagement coupling members 42 of the position regulating mechanism 40 are slided inside the second guide grooves 41*a* of the second guide members 41, but the engagement coupling members 42 and the laminated heat insulating material 4*a* of the vacuum insulating layer 4 do not relatively move with respect to the inner tank 3, most part of the vacuum insulating layer 4 can easily be exposed externally, without having a bad influence on the laminated heat insulating material 4*a* by the engagement coupling members 42, thereby allowing the easy maintenance.

After the maintenance of the vacuum insulating layer 4 is finished, the outer tank main body 5L is externally disposed over the inner tank 3 from below, or the heat insulating vessel portions other than the outer tank main body 5L are inserted from above into the outer tank main body 5L, while the engagement flanges 42*b* engage with the second guide grooves 41*a* of the second guide members 41, the fourth flange 21 is brought into contact with the third flange 20 and the seal member 22 for low temperature, and the second fastening part 24 is fastened.

In addition, the position regulating mechanism 40 having the simple structure can carry out the positional regulation so that the inner tank 3 does not move in a direction perpendicular to the axis with respect to the outer tank 5. Since the vacuum-pump port 14 is formed in the outer tank upper part 5U, the outer tank main body 5L can be removed without affecting the signal wires etc. introduced into the vacuum insulating layer 4 from the vacuum-pump port 14.

Since the pressure detecting pipes 11 and 12 and the drain pipe 13 are penetratedly fixed to the outer tank upper part 5U, the outer tank main body 5L can be removed without affecting the pressure detecting pipes 11 and 12 and the drain pipe 13.

Since at least one of the second guide member 41 and the engagement coupling member 42 is made of fiber-reinforced synthetic resin, the heat input from the outside into the heat insulating vessel 1 for the low temperature liquefied gas pump can be reduced, thereby improving the insulation efficiency.

Embodiment 2

Figure 6:
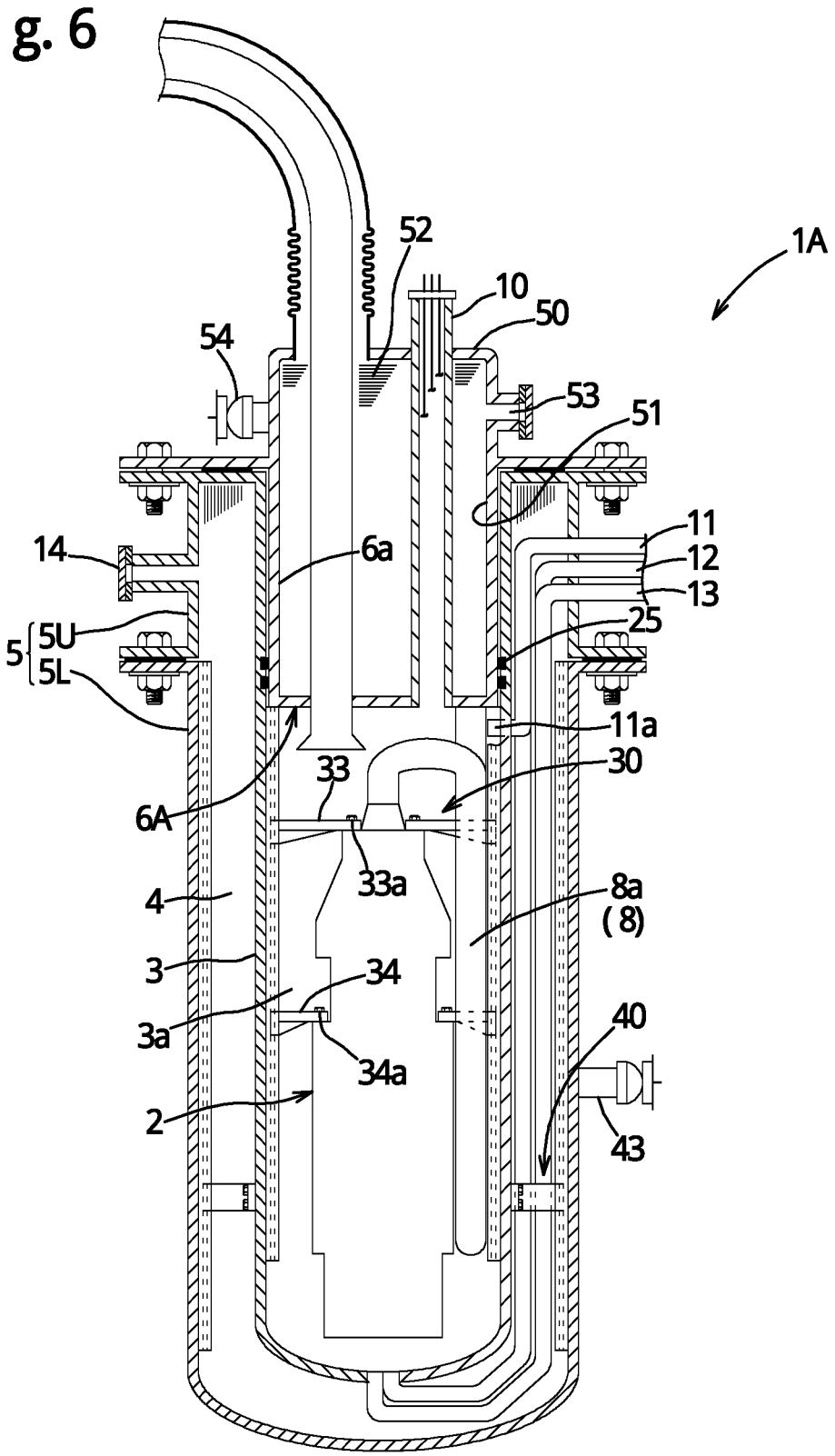
FIG. 6 is a cross-sectional view of a heat insulating vessel for the low temperature liquefied gas pump of Embodiment 2.

As illustrated in FIG. 6, since most part of a heat insulating vessel 1A for low temperature liquefied gas pump of Embodiment 2 are similar to the heat insulating vessel 1 for the low temperature liquefied gas pump of Embodiment 1, the same reference characters are assigned to the same components to omit the description, and only different structures will be described.

While the vertical length of the outer tank upper part 5U is shortened, the vertical length of a lid structure 6A inserted in the inner tank 3 is also shortened. Instead, the cylindrical body 6*a* of the lid structure 6A is extended upwardly above the second flange 16, and a top plate 50 which plugs up an upper end of the cylindrical body 6*a* is joined. The vertical length of the lid structure 6A is shorter than that of the lid structure 6 of Embodiment 1.

A vacuum insulating layer 51 is formed in a space outside the pipes 7-10 among the interior space of the cylindrical body 6*a*, and a laminated heat insulating material 52 (SI) is stacked horizontally in the vacuum insulating layer 51, and the space is held at a vacuum state. Thus, the lid structure 6A also has the vacuum insulating dual structure. In the cylindrical body 6*a*, above the second flange 16, a vacuum-pump port 53 is formed and a rupture disk 54 is also provided.

The vacuum insulating layer 51 can further improve the insulation efficiency of the lid structure 6A. Other operation and effects are similar to those of Embodiment 1.

Embodiment 3

Figure 7:
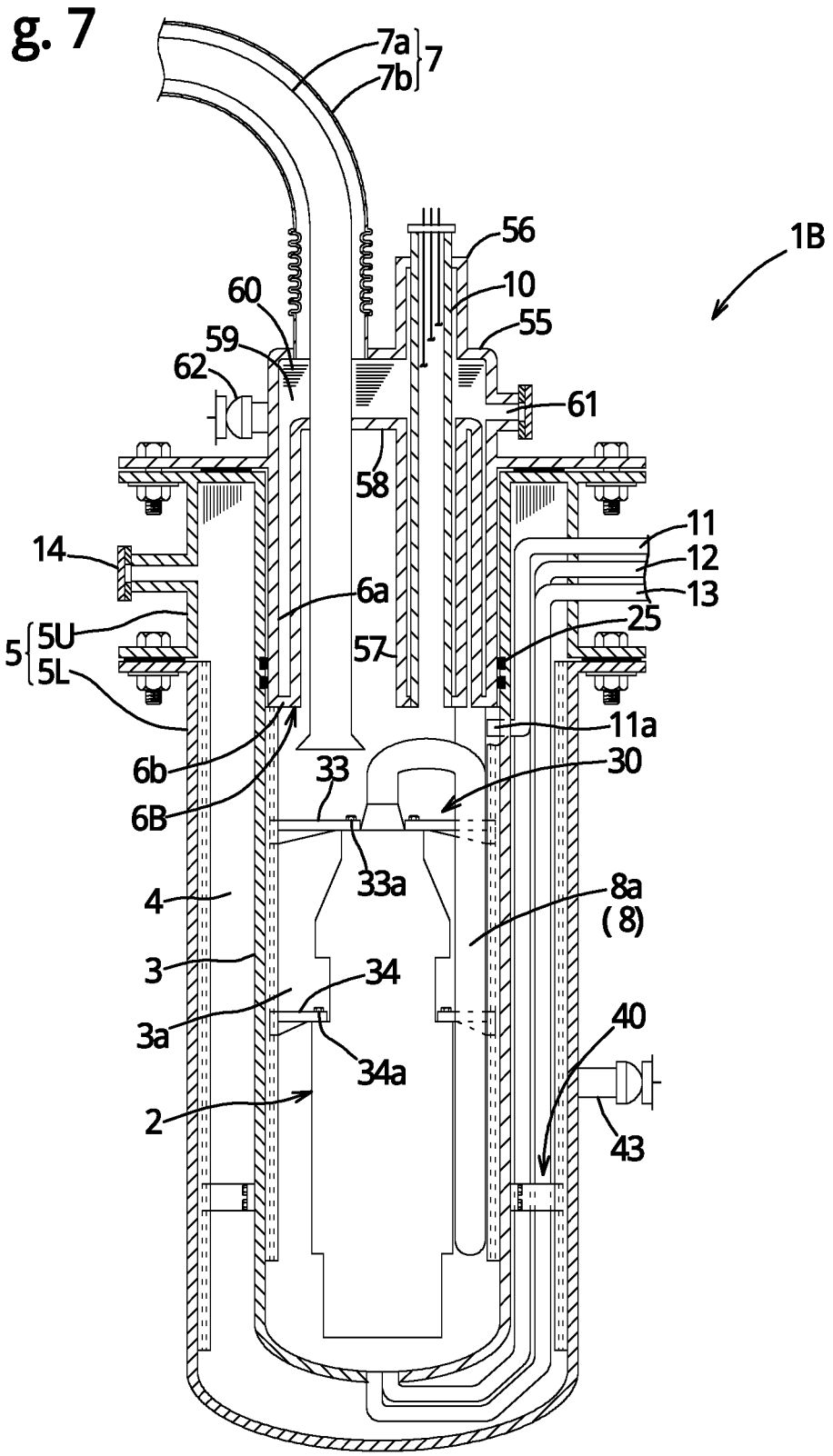
FIG. 7 is a cross-sectional view of a heat insulating vessel for the low temperature liquefied gas pump of Embodiment 3.

As illustrated in FIG. 7, since most part of a heat insulating vessel 1B for low temperature liquefied gas pump of Embodiment 3 are similar to the heat insulating vessel 1 for the low temperature liquefied gas pump of Embodiment 1, the same reference characters are assigned to the same components to omit the description, and only different structures will be described.

While the vertical length of the outer tank upper part 5U is shortened, the vertical length of a lid structure 6B inserted in the inner tank 3 is also shortened. Instead, the cylindrical body 6*a* of the lid structure 6B is extended upwardly above the second flange 16, and a top plate 55 which plugs up the upper end of the cylindrical body 6*a* is joined. The vertical length of the lid structure 6B is shorter than that of the lid structure 6 of Embodiment 1.

A cylindrical part 56 which covers a protruded part of the electric wire pipe 10 is joined to the top plate 55. A cylindrical part 57 which surrounds the inner pipe 7*a* of the suction pipe 7 and a cylindrical part which surrounds the discharge pipe 8 are joined to the bottom plate 6*b*, and an upper end of the cylindrical part 57 is closed with a closure plate 58.

A vacuum insulating layer 59 is formed in a space outside the pipes 7-10 among the interior space of the lid structure 6B, and a laminated heat insulating material 60 (SI) is stacked horizontally in the vacuum insulating layer 59, and the space is held at a vacuum state. Thus, the lid structure 6B also has vacuum insulating dual structure. In the cylindrical body 6*a*, above the second flange 16, a vacuum-pump port 61 is formed, and a rupture disk 62 is also provided. The vacuum insulating layer 59 can further improve the insulation efficiency of the lid structure 6B. Moreover, since the cylindrical part 56 which surrounds the upper end portion of the electric wire pipe 10 is formed, the heat input from the electric wire pipe 10 can be reduced. Other operation and effects are similar to those of Embodiment 1.

Next, examples in which the above embodiments are partially changed will be described.

(1) In the heat insulating vessels 1, 1A, and 1B, the outer tank 5, the second guide member 41, and the third and fourth flanges 20 and 21 may be made of common steel.

(2) In the heat insulating vessels 1A and 1B, the top plates 50 and 55 may be connected to the cylindrical body 6*a* by a flange connection.

(3) Note that the structure of each part, and the shape, size, etc. of each component may suitably be changed by a person skilled in the art, without departing from the spirit of the present disclosure, and the present disclosure also encompasses these modifications.

DESCRIPTION OF REFERENCE CHARACTERS

1, 1A, 1B Heat Insulating Vessel for Low Temperature Liquefied Gas Pump
2 Low Temperature Liquefied Gas Pump
3 Inner Tank
4 Vacuum Insulating Layer
4*a* Laminated Heat Insulating Material
5 Outer Tank
5U Outer Tank Upper Part

5L Outer Tank Main Body
6, 6A, 6B Lid Structure
7 Suction Pipe
8 Discharge Pipe
9 Gas Pipe
10 Electric Wire Pipe
11, 12 Pressure Detecting Pipe
13 Drain Pipe
14 Vacuum-pump Port
15 First Flange
16 Second Flange
19 First Fastening Part
20 Third Flange
21 Fourth Flange
24 Second Fastening Part
26 Synthetic Resin Foamed Body
30 Pump Supporting Mechanism
31 First Guide Member
31*a* First Guide Groove
32 First Bar-like Member
33, 34 Coupling Member
40 Position Regulating Mechanism
41 Second Guide Member
41*a* Second Guide Groove
42 Engagement Coupling Member
52, 60 Laminated Heat Insulating Material
53, 61 Vacuum-pump Port

The invention claimed is:

1. A heat insulating vessel for a low temperature liquefied gas pump, comprising an inner tank configured to accommodate low temperature liquefied gas, an outer tank provided externally around the inner tank, and a low temperature liquefied gas pump disposed inside the inner tank, wherein the outer tank has an outer tank upper part that is an upper end side portion thereof, and an outer tank main body other than the outer tank upper part, wherein a lid structure having a heat-insulated structure detachably fitted into an upper part of the inner tank is provided, wherein the pump is fixed to the lid structure, and a suction pipe and a discharge pipe are insertedly fixed to the lid structure, wherein a vacuum insulating layer is formed between the inner tank and the outer tank, and wherein the pump is fixed to the lid structure through a pump supporting mechanism that includes:

a plurality of first guide members fixed to an inner surface of the inner tank and each having a vertical first guide groove;

a plurality of first bar-like members slidably attached to the first guide grooves of the plurality of first guide members, upper ends of the first bar-like members being coupled to the lid structure; and a plurality of coupling members coupling the pump to the plurality of first bar-like members.

2. A heat insulating vessel for a low temperature liquefied gas pump, comprising an inner tank configured to accommodate low temperature liquefied gas, an outer tank provided externally around the inner tank, and a low temperature liquefied gas pump disposed inside the inner tank, wherein the outer tank has an outer tank upper part that is an upper end side portion thereof, and an outer tank main body other than the outer tank upper part, wherein a lid structure having a heat-insulated structure detachably fitted into an upper part of the inner tank is provided, wherein the pump is fixed to the lid structure, and a suction pipe and a discharge pipe are insertedly fixed to the lid structure, wherein a vacuum insulating layer is formed between the inner tank and the outer tank, wherein a synthetic resin foamed body is provided inside the lid structure, wherein laminated heat insulating material is provided within a heat insulation gap inside the lid structure, and a vacuum layer is formed inside the lid structure, and wherein a vacuum-pump port is formed in the lid structure.

* * * * *